US005305386A

United States Patent [19]

Yamato

[11] Patent Number: 5,305,386

[45] Date of Patent: Apr. 19, 1994

[54] APPARATUS FOR EXPANDING AND CONTROLLING SOUND FIELDS

[75] Inventor: Toshitaka Yamato, Kobe, Japan

[73] Assignee: Fujitsu Ten Limited, Hyogo, Japan

[21] Appl. No.: 775,523

[22] Filed: Oct. 15, 1991

[30] Foreign Application Priority Data

Oct. 15, 1990 [JP] Japan ..... 2-108379[U]
Nov. 1, 1990 [JP] Japan ..... 2-115812[U]

[51] Int. Cl.[5] ..... H04S 1/00

[52] U.S. Cl. ..... 381/1; 381/63; 381/86; 381/17

[58] Field of Search ..... 381/1, 63, 86, 17, 97

[56] References Cited

U.S. PATENT DOCUMENTS 4,329,544 5/1982 Yamada ..... 381/1
4,622,691 11/1986 Tokumo et al. .
4,856,064 8/1989 Iwamatsu ..... 381/1
4,866,776 9/1989 Kasai et al. .
4,953,219 8/1990 Kasai et al. .
4,953,219 8/1990 Kasai et al. .
4,980,914 12/1990 Kunungi et al. ..... 381/1
5,040,219 8/1991 Ando et al. ..... 381/63

FOREIGN PATENT DOCUMENTS

0160431B1 4/1985 European Pat. Off. .
0276948A2 1/1988 European Pat. Off. .
0422955A2 10/1990 European Pat. Off. .
1-40560 8/1989 Japan .

*Primary Examiner*—Forester W. Isen
*Attorney, Agent, or Firm*—Wenderoth, Lind & Ponack

[57] ABSTRACT

An apparatus for correcting asymmetrical sound fields at a listener's position as in an automotive vehicle compartment in which right and left loudspeakers are disposed at positions angularly different relative to the listener's position, wherein stereo-sound signals from an acoustic signal source are output as acoustic signals of fundamental sounds to the right and left loudspeakers and, at same time, effective sounds, such as early reflection and reverberation sounds, are formed for right and left channels by arithmetically processing the acoustic signals of fundamental sounds, which acoustic signals of right- and left-channel effective sounds are outputted respectively to the right and left loudspeakers respectively. Furthermore, a signal which corrects at least one of the phase and level of the left-channel acoustic signal of fundamental sound, and a signal which corrects at least one of the phase and level of the left-channel acoustic signal of effective sound are supplied to the right channel loudspeaker or a center channel loudspeaker disposed between the right and left loudspeakers. Likewise, signals which corrects at least one of the phase and level of the right-channel acoustic signal of fundamental sound and of the right-channel acoustic signal of effective sound are supplied to the left channel loudspeaker or the center channel loudspeaker.

18 Claims, 14 Drawing Sheets

Fig.1 (1)
Prior Art
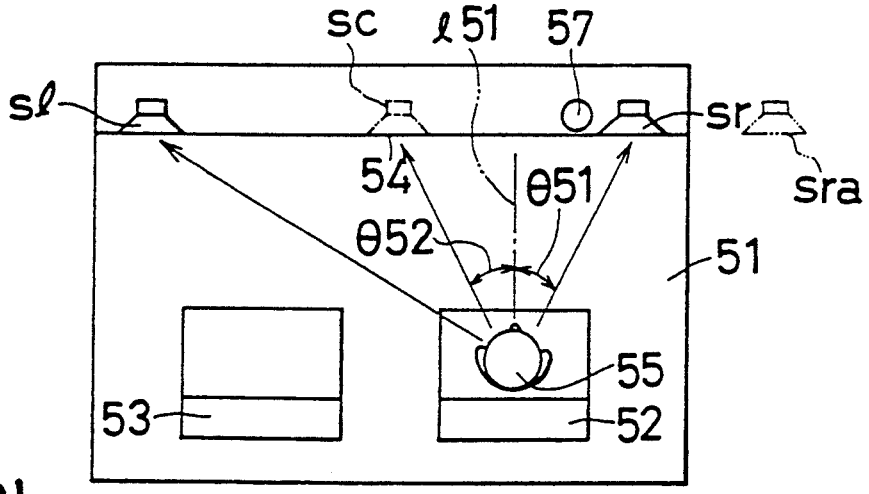
Fig.1 (2)
Prior Art
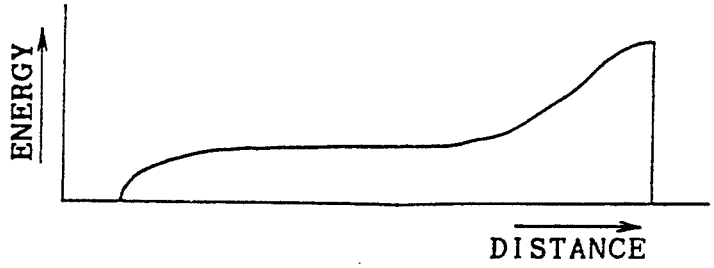

Fig. 4 (1)
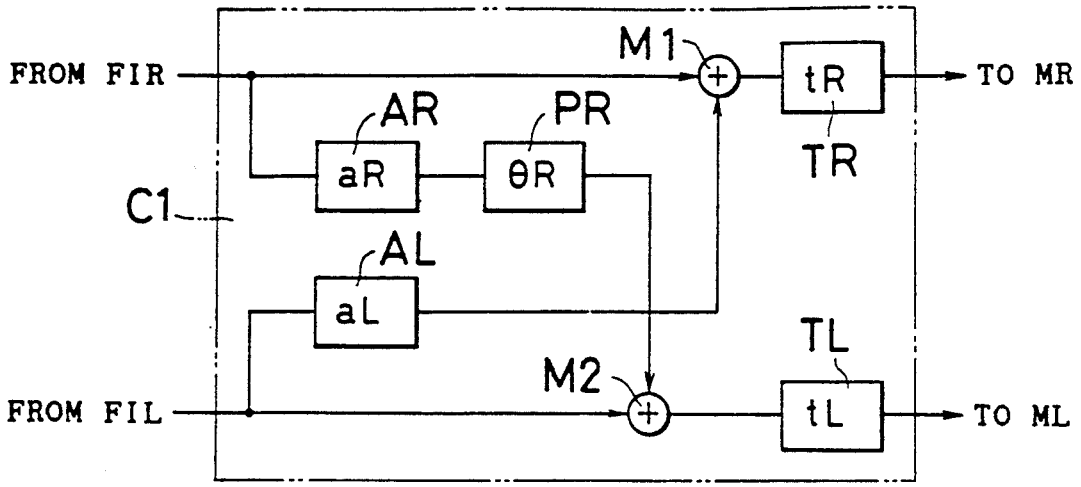
Fig. 4 (2)
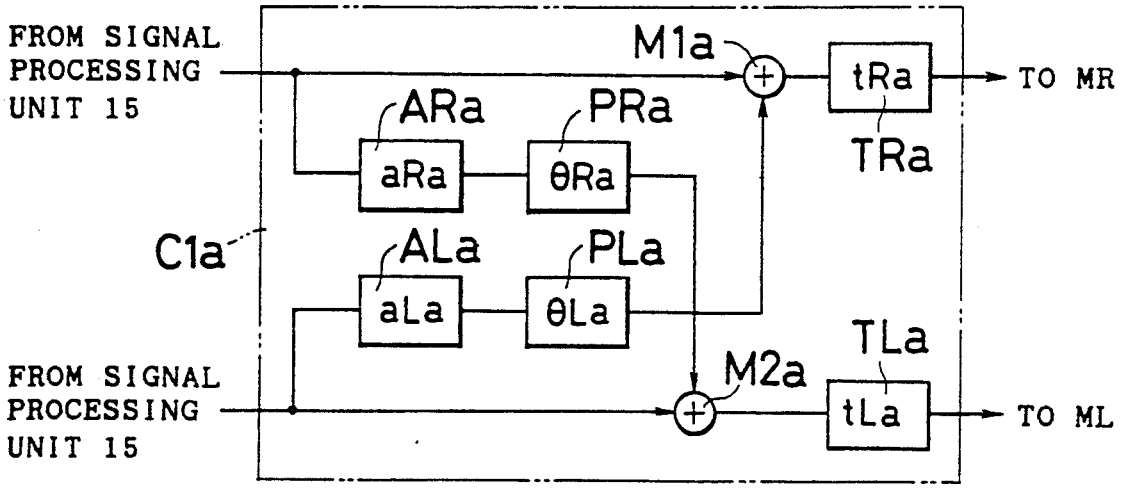

Fig.5 (1)
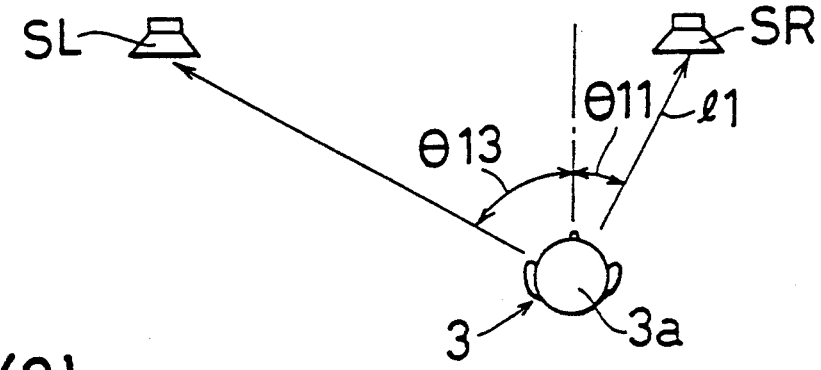
Fig.5 (2)
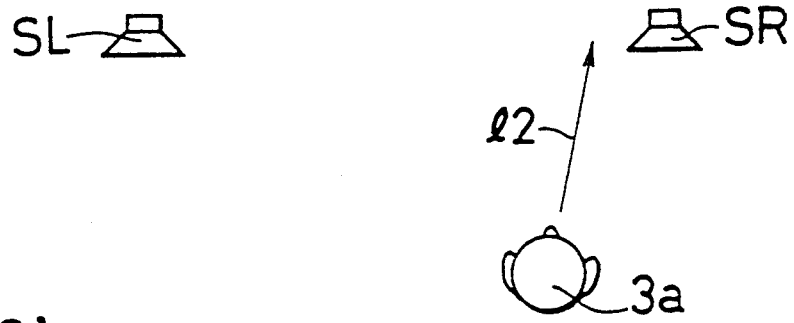
Fig.5 (3)
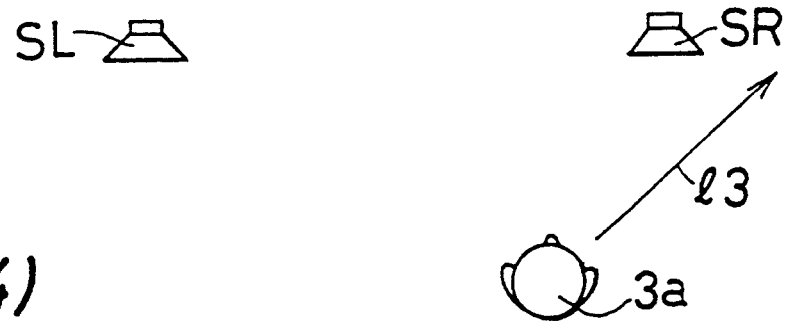
Fig.5 (4)
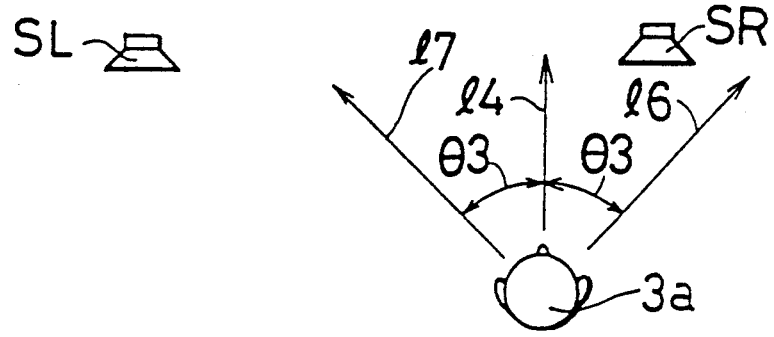

DR
DR1
DR2
DRn
MEMORY CELL
ΔTR1
ΔTR2
ΔTRn
qR1
qR2
qRn-1
qRn
QR1
QR2
QRn-1
QRn
24
31
Rch
TO SIGNAL PROCESSING UNIT 16
DL
DL1
DL2
DLn
ΔTL1
ΔTL2
ΔTLn
qL1
qL2
qLn-1
qLn
QL1
QL2
QLn-1
QLn
23
29
Lch
TO SIGNAL PROCESSING UNIT 16
28
ΔTb
DELAY MEMORY
30
25
26
ΔTa
qa
27
22
EARLY DELAY
T1
T2
21
Rch
Lch
FROM ADDR
FROM ADDL

Fig.12 (1)
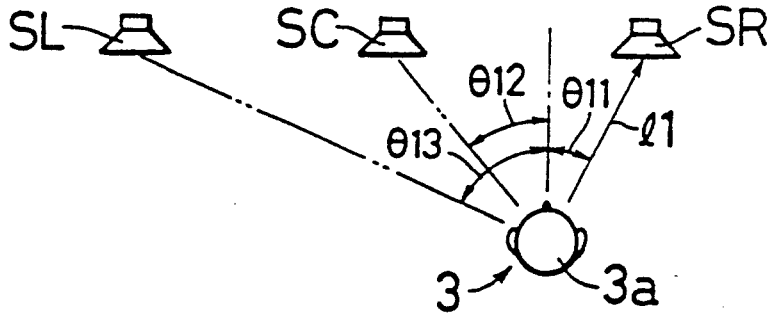
Fig.12 (2)
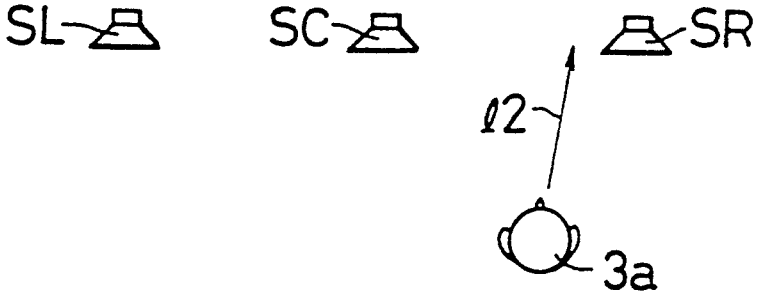
Fig.12 (3)
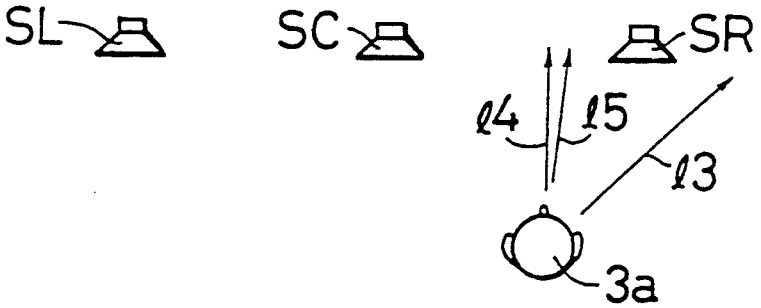
Fig.12 (4)
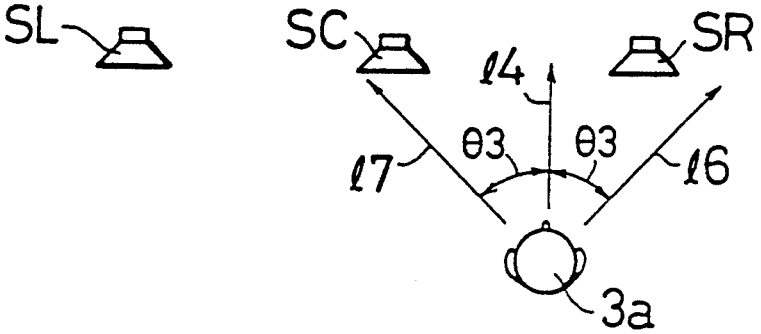

Fig.13 (1)
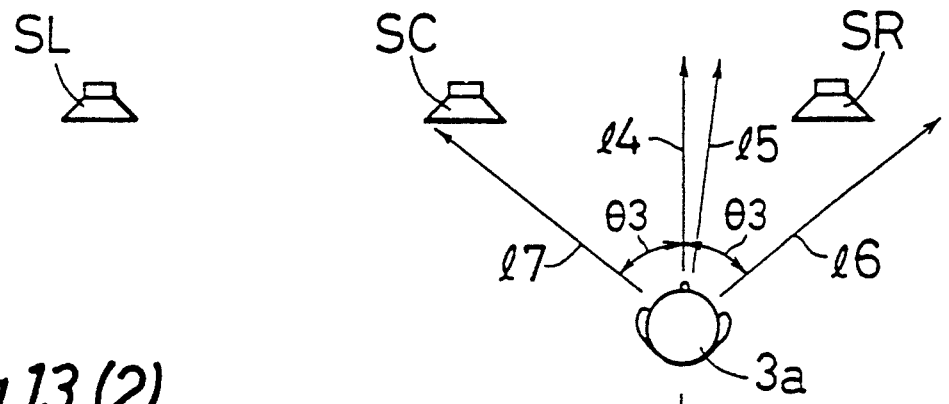
Fig.13 (2)
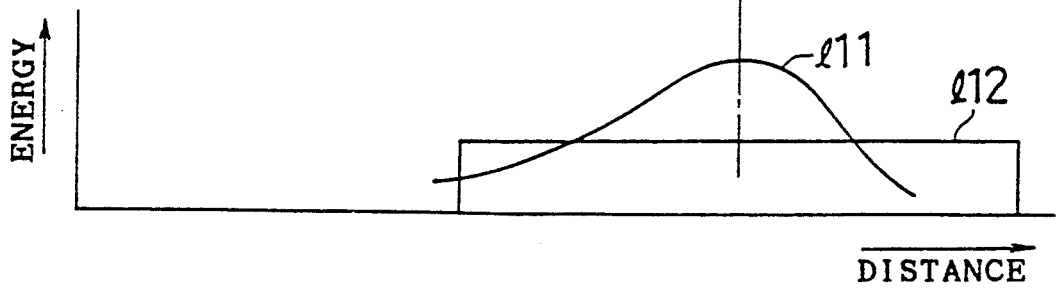

APPARATUS FOR EXPANDING AND CONTROLLING SOUND FIELDS

BACKGROUND OF THE INVENTION

1. Field of the Invention

The present invention relates to an apparatus for expanding and controlling sound fields designed to correct the asymmetry of sound fields that will occur as in an automotive vehicle compartment when stereophonic signals are reproduced by loudspeakers disposed laterally asymmetrically relative to a listening position, and to expand the expanse of the sound fields for stereo-sound reproduction with presence.

2. Description of the Prior Art

FIG. 1 (1) is a plan view explanatory of asymmetric sound fields formed within a vehicle compartment 51. In automotive stereo-sound reproducing apparatuses, as FIG. 1 (1) shows, in a vehicle compartment 51, a right-channel loudspeaker sr is disposed at a front right position of a driver's seat 52, while a left-channel loudspeaker sl is disposed at a front left position of a side seat 53. These loudspeakers sl, sr are built, for example, in an instrument panel 54.

In a typical prior-art arrangement, the loudspeakers sl and sr are supplied with acoustic signals from a sound signal source as adjusted in only right- and left-side balance, that is level.

Therefore, when sounds of equal energy level are released from the loudspeakers sl and sr, at the position of driver 55 as shown, the acoustic energy distribution on the hearing sense of the driver 55, as FIG. 1 (2) shows, is not uniform between the left and right loudspeakers sl and sr and tends to become biased toward the loudspeaker sr which is nearer to the driver 55.

Accordingly, the localization position of virtual sound source that should primarily be localized in the frontward direction of the driver 55 indicated by reference character 151 becomes biased toward the loudspeaker sr indicated by reference character 57. Even when the adjustment of the above mentioned balance is made, the acoustic energy distribution cannot be balanced between the right side and the left side, and the angle of lateral divergence or bias of the sound fields cannot be corrected.

With prior art automotive stereo-sound reproducing apparatuses, therefore, the problem is that the direction of localization of an sound image is deviated from the forward direction to form an asymmetrical sound image and this prevents sound reproduction full of presence.

An approach toward solving the foregoing problem is described in U.S. Pat. No. 4,866,776. According to this prior art disclosure, a center loudspeaker sc is disposed between loudspeakers sl and sr of left- and right-side channels on an instrument panel 54. At the center loudspeaker sc, added signals comprising acoustic signals of left- and right-side channels are converted into acoustic vibrations.

Through this arrangement, at a right side seat 51 as viewed in the forward direction of vehicle compartment 51, sound fields are formed by the right-channel loudspeaker sr and center loudspeaker sc, while at a left-side seat 53, sound fields are formed by the left-channel loudspeaker sl and center loudspeaker sc. Thus, sound fields that are comparatively well balanced between the right- and left-channels are formed at both the right-side and left-side seats.

In this prior art arrangement, however, the right-channel loudspeaker sr is disposed at angle θ51 relative to the frontward direction shown by reference character 151, whereas the center loudspeaker sc is disposed angle θ52 which angle is wider than the angle θ51. Therefore, the sound which the driver 55 hears involves some deviation in phase as pointed out above according to the difference in distance between the listening position of the driver and the respective loudspeakers sr, sc.

Another problem is that in the limited space of the compartment 51, because of the limitations as to the mounting positions of the loudspeakers sl, sr, the angle of divergence shown by reference character θ51 is smaller than 30 degrees, an angle which can form an ideal sound field. At the position of the driver 55, this is such that the direction of the source of the right-channel sound cannot be localized outwardly of the loudspeaker sr which is disposed at a comparatively narrow angle of divergence. Therefore, the sound field is very narrow and provides no satisfactory presence.

Such a problem occurs likewise with a television receiver in which the right and left loudspeakers are narrowly spaced. When the viewer moves away from the screen to a location suitable for viewing the screen, the angle of divergence becomes very narrow because of the narrow distance between the two loudspeakers and the viewer cannot enjoy good presence.

Another prior art arrangement which is intended to overcome this deficiency is disclosed in U.S. Pat. No. 4,953,219. In this prior art disclosure, a delay period for formation of reverberation sounds is selected on the basis of reverberation time within the vehicle compartment 51 that has been previously measured, whereby reverberation sounds of a generally acceptable level may be produced to compensate for a lack of presence.

However, with reverberation sounds only, no wide distribution of fundamental sounds such as vocal sounds can be obtained, it being thus difficult to improve the sense of presence to any satisfactory extent.

Another prior art arrangement intended to solve the above problem is disclosed in Japanese Patent Publication JP 1-40560. According to this prior art arrangement, reverberation sounds are added and, in addition, it is arranged that at the seat position of the driver 55, for example, the acoustic signal of the right channel for the loudspeaker sr as adjusted in phase and level are output from the loudspeaker sl, whereby some good result can be obtained which is equivalent to that obtainable in the case where the right channel loudspeaker sr is disposed at a position indicated by reference character sra. In this way, an improved sense of presence has been achieved through the expanding of the sound fields and the addition of reverberation sounds.

In this prior art arrangement, however, respective sound fields of acoustic signals of fundamental sounds from acoustic signal sources, such as a magnetic tape reproducing device and a radio receiver, and of acoustic signals of added reverberation sounds are collectively expanded and, therefore, sound images of vocal sounds and the like cannot be localized in the frontward direction.

SUMMARY OF THE INVENTION

Accordingly it is a primary object of the invention to provide a novel and improved an apparatus for expanding and controlling sound fields which is intended to solve the foregoing problems.

It is another object of the invention to provide an apparatus for expanding and controlling sound fields which can form laterally symmetrical, wider sound fields and perform acoustic reproduction full of presence.

In order to accomplish the above objects, the invention provides an apparatus for expanding and controlling sound fields comprising:

an acoustic signal source which outputs acoustic signals of fundamental sounds of two channels, right and left;

a means for correcting at least one of the phase and level of acoustic signals of fundamental sounds of the right and left channels and outputting same;

a means for arithmetically processing with acoustic signals of fundamental sounds of the right and left channels from the acoustic signal source to produce acoustic signals of effective sounds of the right and left channels; and a means for correcting at least one of the phase and level of acoustic signals of effective sounds of the right and left channels and outputting same, wherein outputs of the right and left channels from the fundamental sounds correcting means and corresponding outputs of the right and left channels from the effective sounds correcting means are added together for each of the right and left channels, which are, in turn, outputted from a common loudspeaker for each channel.

According to the invention, left and right loudspeakers which perform stereo-sound reproduction are disposed, as in an automotive vehicle compartment, at angularly different positions relative to the frontward direction of a listening position.

Stereo-sound signals of left and right channels, with no early reflection sound or reverberation sound added, are output from acoustic signal sources, such as a magnetic tape reproducing unit and a radio receiver, which sound signals, as acoustic signals of fundamental sounds, are inputted to fundamental sounds correcting means and effective sounds making means. The effective sounds making means carry out arithmetic processing with acoustic signals of fundamental sounds to produce acoustic signals of effective sounds, such as early reflection sounds and reverberation sounds, and output same to the effective sounds correcting means.

The fundamental sounds correcting means and effective sounds correcting means correct at least one of the phase and level of input acoustic signals of fundamental sounds or effective sounds, as the case may be, of left and right channels. Acoustic signals of left and right channels outputted respectively from the fundamental sounds correcting means and effective sounds correcting means are added together for each of the corresponding channels and produced as sounds from common loudspeakers for respective channels. Therefore, by controlling the amounts of correction of the phase and level, it is possible to expand the sound fields of the effective sounds more than the sound fields of the fundamental sounds and thus to form sound fields having a wider image effect.

At a listening position angularly different relative to the left and right loudspeakers in this way, sound image of fundamental sounds can be forwardly localized and their sound fields can be laterally symmetrically formed. Further, sound fields of effective sounds can be formed wider than sound fields of fundamental sounds. Thus, it is possible to form sound fields which are laterally symmetrical, localized in the frontward direction, and of a broader effect.

According to another aspect of the invention, there is provided an apparatus for expanding and controlling sound fields comprising:

an acoustic signal source which outputs acoustic signals of fundamental sounds of two channels, right and left;

a means for correcting at least one of the phase and level of acoustic signals of fundamental sounds of the right and left channels to form outputs of right, left and center channels;

a means for arithmetically processing with acoustic signals of fundamental sounds of the right and left channels from the acoustic signal source to produce acoustic signals of effective sounds of the right and left channels; and a means for correcting at least one of the phase and level of acoustic signals of effective sounds of the right and left channels to form outputs of right, left and center channels; and wherein outputs of respective channels from the fundamental sounds correcting means and corresponding outputs of respective channels from the effective sounds correcting means are added together for each of the right, left and center channels, which are, in turn, outputted from a common loudspeaker for each channels.

Further, according to the invention, stereo-sound signals of fundamental sounds of left and right channels from the acoustic signal sources are inputted to the fundamental sounds correcting means and effective sounds making means. The effective sounds making means carry out arithmetic processing with respect to acoustic signals of fundamental sounds to produce acoustic signals of effective sounds of left and right channels.

The fundamental sounds correcting means and effective sounds correcting means correct at least one of the phase and level of input acoustic signals of fundamental sounds or effective sounds of left and right channels to produce acoustic signals of fundamental sounds or effective sounds of left, right and center channels. Acoustic signals of left, right, and center channels from the fundamental sounds correcting means and acoustic signals of corresponding channels from the effective sounds correcting means are added together and are then produced as sounds from common loudspeakers from respective channels.

Thus, at right and left listening positions, sound fields for fundamental sounds can be laterally symmetrically formed, with sound images localized in the frontward direction, and by forming sound fields for effective sounds wider than sound fields for fundamental sounds, it is possible to carry out satisfactory sound reproduction which is full of presence.

BRIEF DESCRIPTION OF THE DRAWINGS

These and other objects, features and advantages of the invention will be more explicit from the following detailed description taken with reference to the drawings wherein:

FIGS. 1(1) and 1(2) are a plan view and energy distribution graph used for an explanation of the prior art;

FIGS. 4(1) and 4(2) are functional block diagrams used for an explanation in detail of crosstalk generating units C1 and C1*a;*

FIGS. 5(1)-5(4) are plan views used for an explanation of functions of sound image control units U1 to U3;

FIGS. 12(1)-12(4) are plan views used for an explanation of the functions of acoustic image control units Ua1 to Ua3;

FIGS. 13(1)-13(2) are a plan view and energy is a distribution graph of sound energies used for an explanation of asymmetrical sound fields.

DETAILED DESCRIPTION OF THE PREFERRED EMBODIMENTS

Figure 2:
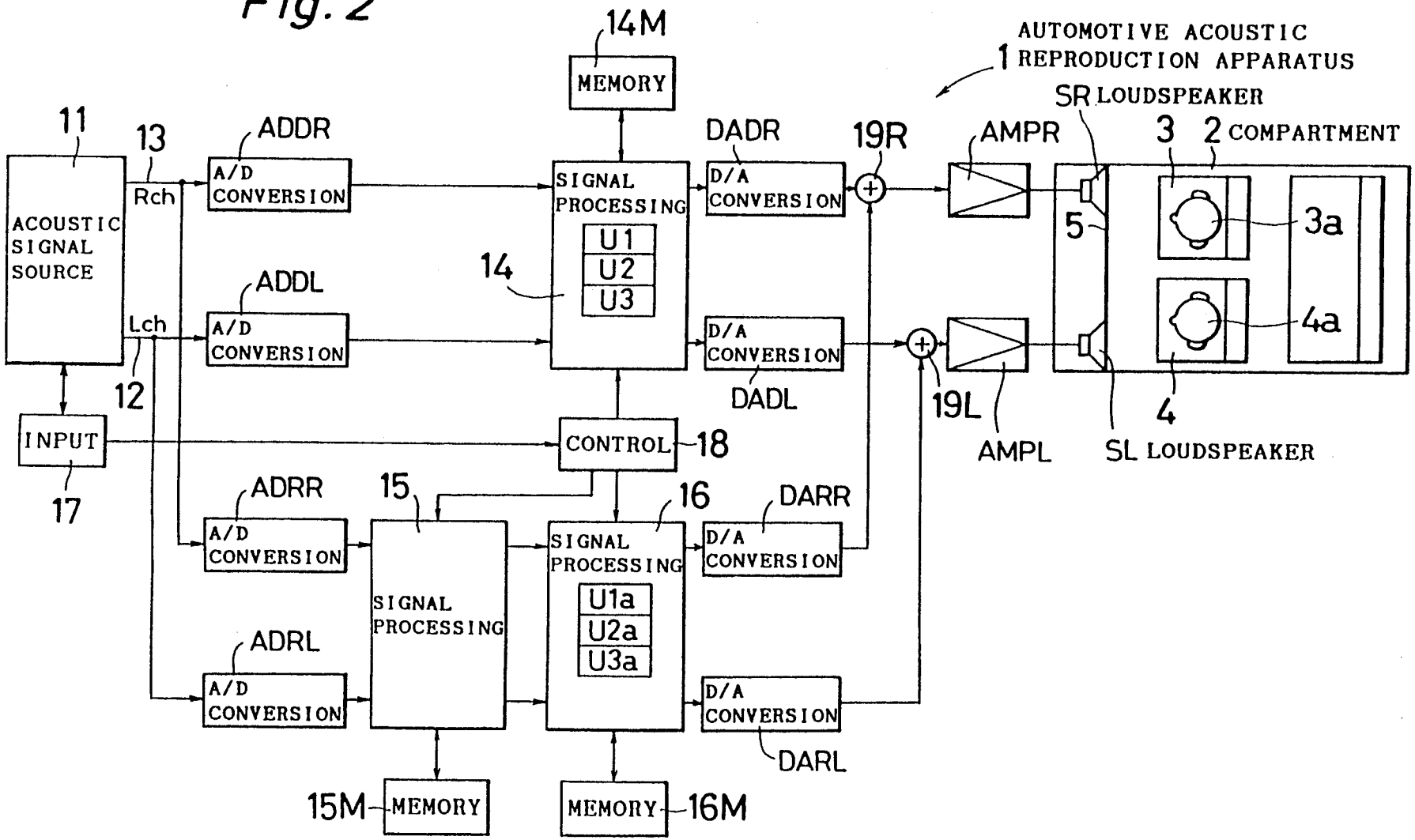
FIG. 2 is a block diagram of an automotive acoustic reproducing apparatus 1 representing one embodiment of the present invention.

Now referring to the drawing, preferred embodiments of the invention are described below.

FIG. 2 is a block diagram of an automotive acoustic reproducing apparatus 1 in accordance with one embodiment of the present invention. In a vehicle compartment 2, loudspeakers SL and SR are mounted on a instrument panel 5 disposed in front of a driver's seat 3 and an assistant's seat 4. More specifically, on the frontward side of the driver's seat 3 and assistant's seat 4, the loudspeaker SL is disposed at left and the loudspeaker SR is disposed at right.

From an acoustic signal source 11, such as a magnetic tape reproducing unit or radio receiver, an acoustic signals of fundamental sounds of left channel is led out to a line 12, and an acoustic signals of fundamental sound of right channel is let out to a line 13. The acoustic signals of the two channels are inputted to a signal processing unit 14 as fundamental sounds correcting means after they are converted into digital sound signals respectively by analog/digital converters ADDL and ADDR.

The acoustic signals of fundamental sounds of left and right channels from the acoustic signal source 11 are converted by analog/digital converters ADRL and ADRR into digital sound signals before they are inputted to a signal processing unit 15. This signal processing unit 15, as effective sounds making means, carries out arithmetic processing with input acoustic signals of fundamental sounds of left and right channels and produce acoustic signals of effective sounds of left and right channels, which are in turn led out to a signal processing unit 16 as effective sounds correcting means.

The signal processing units 14 to 16 may be so-called digital signal processors or the like. The signal processing units 14 to 16 are equipped individually with corresponding memories 14M to 16M. There is provided a control unit 18 for controlling arithmetic processing of the signal processing units 14 to 16 in response to inputs from an input unit 17. Respective signal processing units 14 to 16, in response to control signals from the control unit 18, carry out delay processing employing the corresponding memories of 14M to 16M. The signal processing unit 15 produce acoustic signals of effective sounds as earlier stated. The signal processing units 14, 16 correct at least one of the phase and level of acoustic signals in manner as will be described later.

Digital sound signals of left and right channels from the signal processing units 14 and 16 are converted by digital/analog converters DADL and DADR, DARL and DARR into analog sound signals, which are in turn added together on a channel by channel component arrangement.

That is, a left-channel acoustic signal of fundamental sound from digital/analog converter DADL and a left-channel acoustic signal of effective sound from digital-/analog converter DARL are added together by adder 19L, and the sum is amplified by a power amplifier AMPL, which is then turned into sound by the loudspeaker SL of the left channel. Likewise, acoustic signals from digital/analog converters DADR and DARR are added together at adder 19R, and the sum is supplied through a power amplifier AMPR to the loudspeaker SR for being released as a sound.

Figure 3:
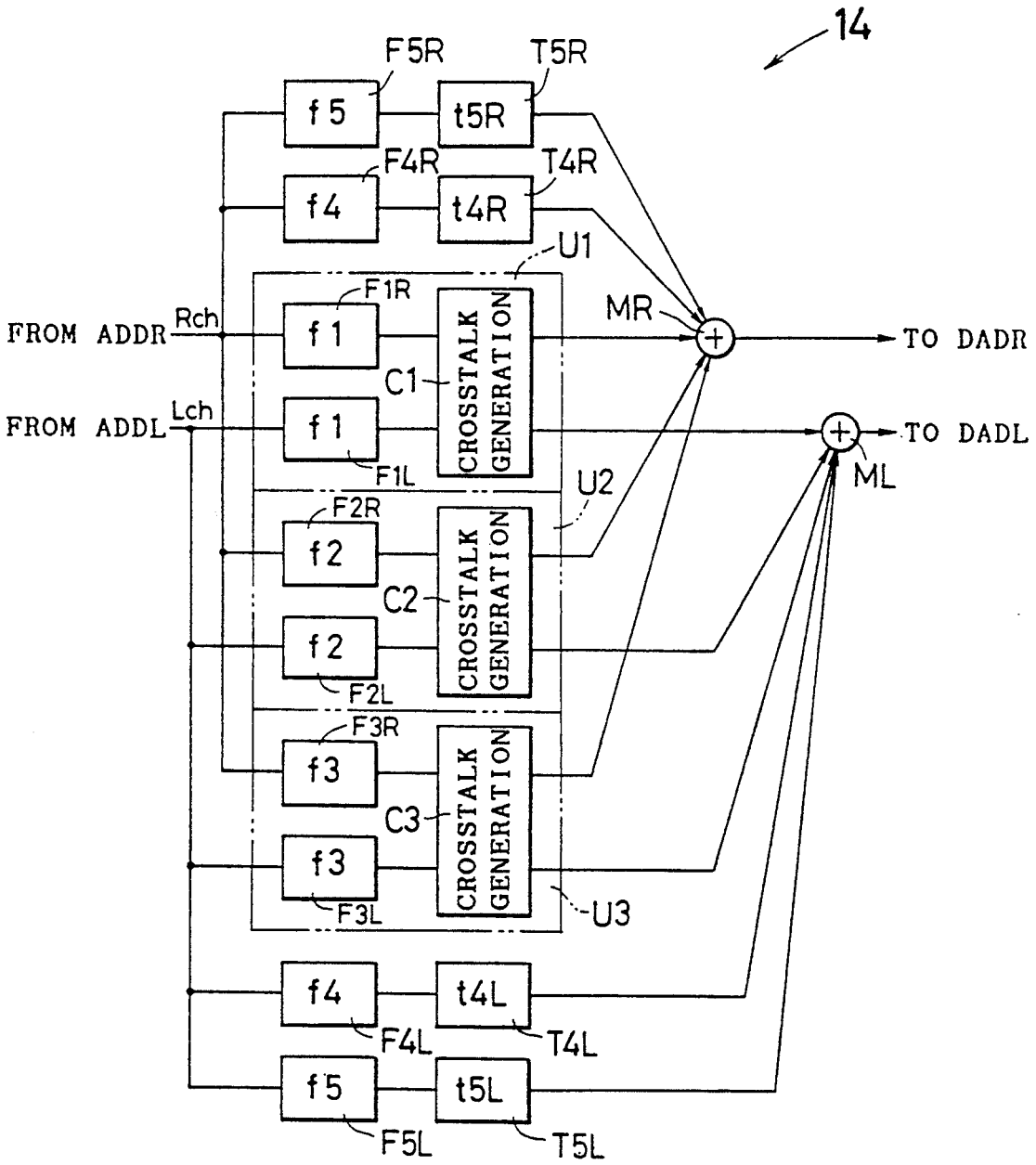
FIG. 3 is a functional block diagram used for an explanation of signal processing operations within a signal processing unit 14.

FIG. 3 is a functional block diagram used for an explanation of the signal processing operation within the signal processing unit 14. Signal processing blocks at the signal processing unit 14 generally include sound image control units U1 to U3, filter units F4L and F4R, F5L and F5R, delay units T4L and T4R, T5L and T5R, and adder units ML and MR.

Generally, transmission characteristics of sounds vary according to the frequency level. For this reason, in order to equalize the phases of all frequency bands heard adjacent the entrance of the auditory area of listeners 3*a* and 4*a* at the driver's seat 3 and assistant's seat 4, the acoustic signals are divided for each predetermined frequency band, and corrected at the sound image control units U1 to U3.

Therefore, the acoustic signal of fundamental sound of left channel inputted to the sound image control unit U1 is inputted to a bandpass filter unit (hereinafter referred to as BPF), at which is signal component of the frequency band f1 to be subjected by the sound image control unit U1, for example, 200 to 400 Hz is filtered. An output of the BPFF1L is inputted to a crosstalk generating unit C1 as will be hereafter described. Likewise, right-channel acoustic signal of fundamental sound is inputted to the crosstalk generating unit C1 after its signal component of frequency band F1 is filtered at a BPFF1R.

Similarly, at the sound image control unit U2, left-channel acoustic signal is inputted to the crosstalk generating unit C2 after its signal component of frequency band f2, for example, 400 to 800 Hz is filtered at a BPFF2L, and right-channel acoustic signal is inputted to the crosstalk generating unit C2 through a BPFF2L.

Again, at the sound image control unit U3, left-channel acoustic signal is inputted to the crosstalk generating unit C3 after its signal component of frequency band f3, for example, 800 to 1600 Hz is filtered by a BPFF3L, and right-channel acoustic signal is inputted to the crosstalk generating unit C3 through a BPFF3R.

A part of the left-channel acoustic signals from analog/digital converter ADDL is inputted to the adder unit ML through the high-pass filter unit (hereinafter referred to as HPF) F4L or the low-pass filter unit (hereinafter referred to as LPF) F5L, and after being delayed time t4L and t5L respectively by delay units T4L and T5L. Similarly, some of the right-channel acoustic signals from analog/digital converter ADDR is inputted to the adder unit MR through a HPFF4R or a LPFF5R, and after being delayed time t4R and t5R respectively by delay units T4R and T5R. The cut-off frequency f4 of the HPFF4L, F4R are selected to be, for example, 1600 Hz, and the cut-off frequency f5 of the LPFF5L, F5R is selected to be, for example, 200 Hz.

FIG. 4 (1) is a functional block diagram used for an explanation in detail of the crosstalk generating unit C1. A part of above mentioned output of the BPFF1L is inputted to an adder unit M1 through an attenuator unit AL, where it is added with to an output from the BPFF1R. The sum is delayed time tR at a delay unit TR and is then output to the adder unit MR.

On the other hand, a part of the output of the BPFF1R is inputted through an attenuator unit AR and a phase unit PR to an adder unit M2, where it is added to the output from the BPFF1L. Thereafter, the sum is delayed time tL by a delay unit TL and is outputted to the adder unit ML. The phase unit PR corrects the phase of input sound signal by θR, and the attenuator units AL and AR attenuate input sound signals by aL and aR. Constants, such as the phase correction amount θR and the attenuation factors aL and aR, for digital signal processing are set by the control unit 18 in response to inputs from the input unit 17.

The sound signal processing unit 16 for effective sounds is of similar construction of the signal processing unit 14. It is noted that as FIG. 4 (2) shows, crosstalk generating unit C1*a* in the sound processing unit 16 is similar to the corresponding crosstalk generating unit C1 in the sound processing unit 14; such similar units in the sound processing unit 16 are identified by suffixing character a to identical reference numerals. At the crosstalk generating unit C1*a* there is provided a phase unit PLa between an attenuator unit ALa and an adder unit M1*a*. Phase correction amounts θLa and θRa of the phase units PLa and PRa and attenuation factors aLa and aRa of the attenuator units ALa and ARa are set at values different from the phase correction amount θR and the attenuation factors aL and aR of the crosstalk generating unit C1.

The crosstalk generating units C2 and C3 are similar in construction to the above mentioned crosstalk generating unit C1, and crosstalk generating units C2*a* and C3*a* in the signal processing unit 16 which correspond to the crosstalk generating units C2 and C3 are constructed the same as that of the crosstalk generating unit C1*a*.

FIGS. 5(1)–5(4) are plan views used for explaining functions of the sound image control units U1 to U3. To listener 3*a* at the driver's seat 3, the loudspeaker SR is disposed at a position which forms a directional angle θ11 relative to him or her, the loudspeaker SL is disposed at a position which forms a wider directional angle θ13 than the angle θ11. When a right-channel sound is released from the loudspeaker SR only as shown in FIG. 5 (1), the listener 3*a* perceives the direction of source of the sound in the direction l1.

When, in conjunction with the sound from the loudspeaker SR, same sound in released also from the loudspeaker SL, the listener 3*a* perceives the direction of the sound source in a substantially frontward direction as shown by reference numeral l2 in FIG. 5 (2).

Thus, by changing the level by the amount aR by the attenuation units AR in the crosstalk generating units C1 to C3 and by shifting the phase by the amount θR by the phase units PR, it is possible to allow the listener 3*a* to perceive the direction of right-channel source of sound in a direction shown by reference character 3, that is, outside of the loudspeaker SR, instead of the previously perceived direction which is internal of the loudspeaker SR as shown by reference character l2.

So, when a left-channel sound is released from the loudspeaker SR via the attenuator unit AL and the left-channel sound from the loudspeaker SL via BPFF1L to F3L shown in FIG. 5(4), laterally symmetrical sound fields can be formed such that the direction of sound image localization corresponds to the frontward direction of listener 3*a* indicated by reference character l4 and the sound fields have an angle of divergence θ3 relative to the frontward direction as indicated by reference characters l6 and l7. This angle of divergence θ3 is realized by adjusting the phase θR so that the angle is of the order of 30 degrees which can provide an ideal sound field.

Figure 6:
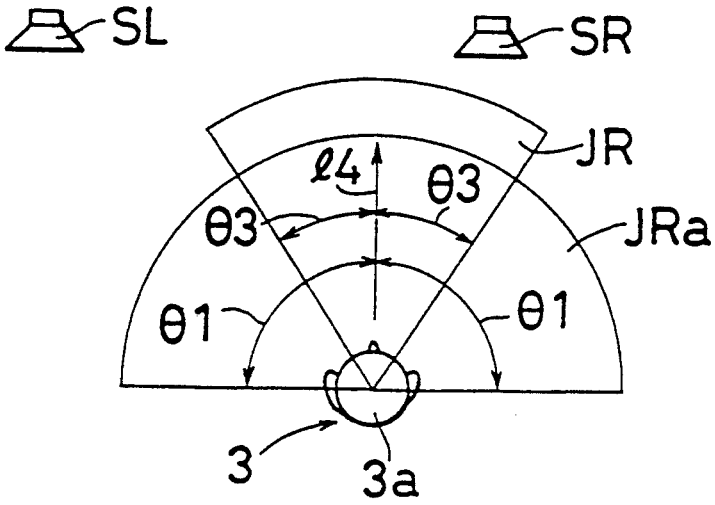
FIG. 6 is a plan view showing the widening effect of a sound field JR of fundamental sounds and a sound field JRa of effective sounds according to the present invention.

Likewise, laterally symmetrical fields can be obtained for effective sounds by adjusting the phase correction amounts θLa and θRa and the attenuation factors aLa and aRa at the crosstalk generating units C1*a* to C3*a* in the sound image control units U1*a* to U3*a*. It is noted that for effective sounds and the phase correction amounts θLa and θRa and the attenuation factors aLa and aRa are adjusted so that an angle of divergence θ1 wider than the angle of divergence θ3 for fundamental sounds are obtained as shown in FIG. 6.

In this way, according to the present embodiment, the sound field of fundamental sounds which are laterally symmetrical relative to the driver's seat 3 as shown by reference character JR are formed so that sound image can be localized in the frontward direction of the listener 3*a* without deviation. The sound field for effective sounds shown by reference character JRa are formed wider than the sound fields JR of fundamental sounds. In the vehicle compartment 2 which is subject to limitations with respect to mounting positions for the loudspeakers SL and SR the sound image can be localized in the frontward direction of the listener 3*a* and wider sound fields can be formed by separately controlling sound field JR of fundamental sounds and sound field JRa of effective sounds.

In the foregoing embodiment, it is intended that optimum sound fields, are formed relative to the driver's seat 3, whereas in another embodiment it may be arranged that sound field are formed relative to the assistant's seat 4. In the latter case, the phase units PR in the crosstalk units C1 to C3 are omitted and, in place thereof, a similar phase units PL are provided between the attenuator unit AL and the adder unit M1. It is also possible to provide both of the phase units PR and PL so that the two phase units PR and PL are selectively operated according to whether optimum sound fields should be formed relative to the driver's seat 3 or the assistant's seat 4.

Such way of correcting asymmetrical sound fields and controlling sound-field expanding may be advantageously applied to television receivers in which the distance between left- and right-channel speakers is small. In this case, signal processing for such correction of asymmetrical sound fields and sound-field expanding control as described above may be carried out at the receiver's side or may be carried out on the broadcasting station's side so that sound signals after signal processing are transmitted.

Figure 7:
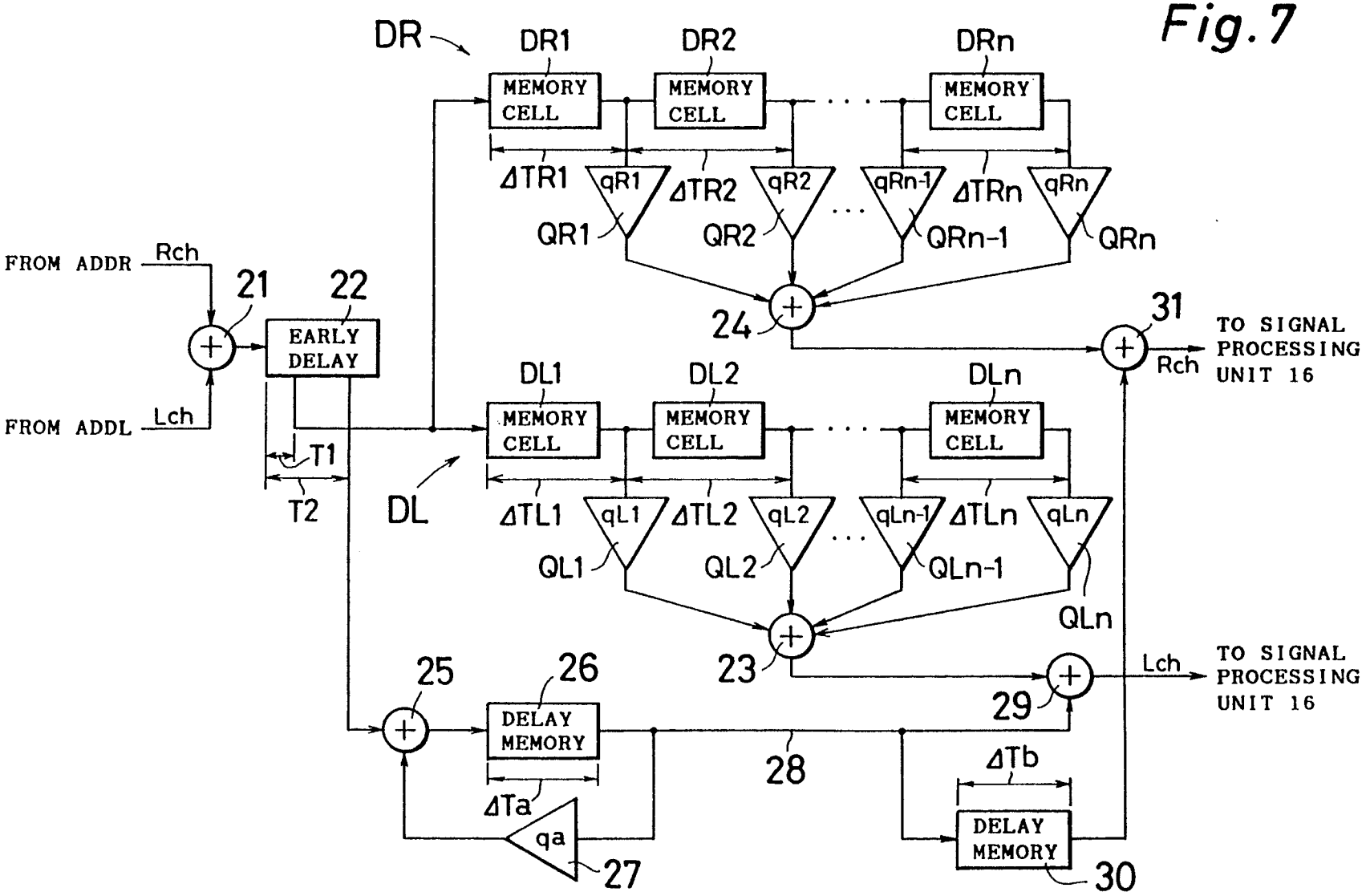
FIG. 7 is a functional block diagram showing a signal processing unit 15.

FIG. 7 is a block diagram showing functions of the signal processing unit 15. The acoustic signals for fundamental sounds of the left and right channels from the analog/digital converters ADRL and ADRR are subjected to adding operation by an adder unit 21 and turned into monaural signals, which are then inputted to an early delay unit 22. The early delay unit 22 delays the monaural signals a predetermined time T1 relative to the acoustic signals of fundamental sounds shown by reference character SD in FIG. 8, and then outputs same to delay memories DL and DR which are respectively provided for the left and right channels.

The delay memory DL comprises a plurality of memory cells DL1, DL2, . . . , DLn. Individual memory cells DL1 to DLn delay input acoustic signals by predetermined times ΔTL1, ΔTL2, . . . , ΔTLn. The output of each memory cell DL1 to DL(n−1) are supplied to a next stages memory cell DL2 to DLn. The outputs of individual memory cells DL1 to DLn are supplied respectively through coefficient units QL1 to QLn to the adder unit 23 at which they are added together. Each coefficient units QL1 to QLn multiplies the output from corresponding memory cells DL1 to DLn by a predetermined factor qL1 to qLn, and then outputs same to an adder unit 23.

A delay memory DR is of same construction as the delay memory DL. In the delay memory DR, however, the delay time at its component memory cells DR1, DR2, . . . , DRn are selected to be TR1, TR2, . . . , TRn respectively; and the factors to be applied at the coefficient units QR1 to QRn are selected to be qR1 to qRn respectively. The output from the coefficient units QR1 to QRn are added together by an adder unit 24.

The early delay unit 22 delays input monaural signals of fundamental sounds a predetermined time ΔT2, and then output same to an adder unit 25. The output from the adder unit 25 is delayed a predetermined comparatively short time ΔTa by a delay memory 26, which is then outputted to line 28. This output is multiplied by a factor qa by a coefficient unit 27 and then fed back to the adder unit 25.

The output from the delay memory 26 via line 28 is added by an adder unit 29 to an output from the adder unit 23, and the sum, as left-channel acoustic signal for effective sounds, is supplied to the signal processing unit 16. Further, the output is delayed a predetermined time ΔTb by a delay memory 30, which is then added by an adder unit 31 to an output from the adder unit 24. The sum is inputted to the signal processing unit 16.

Figure 8:
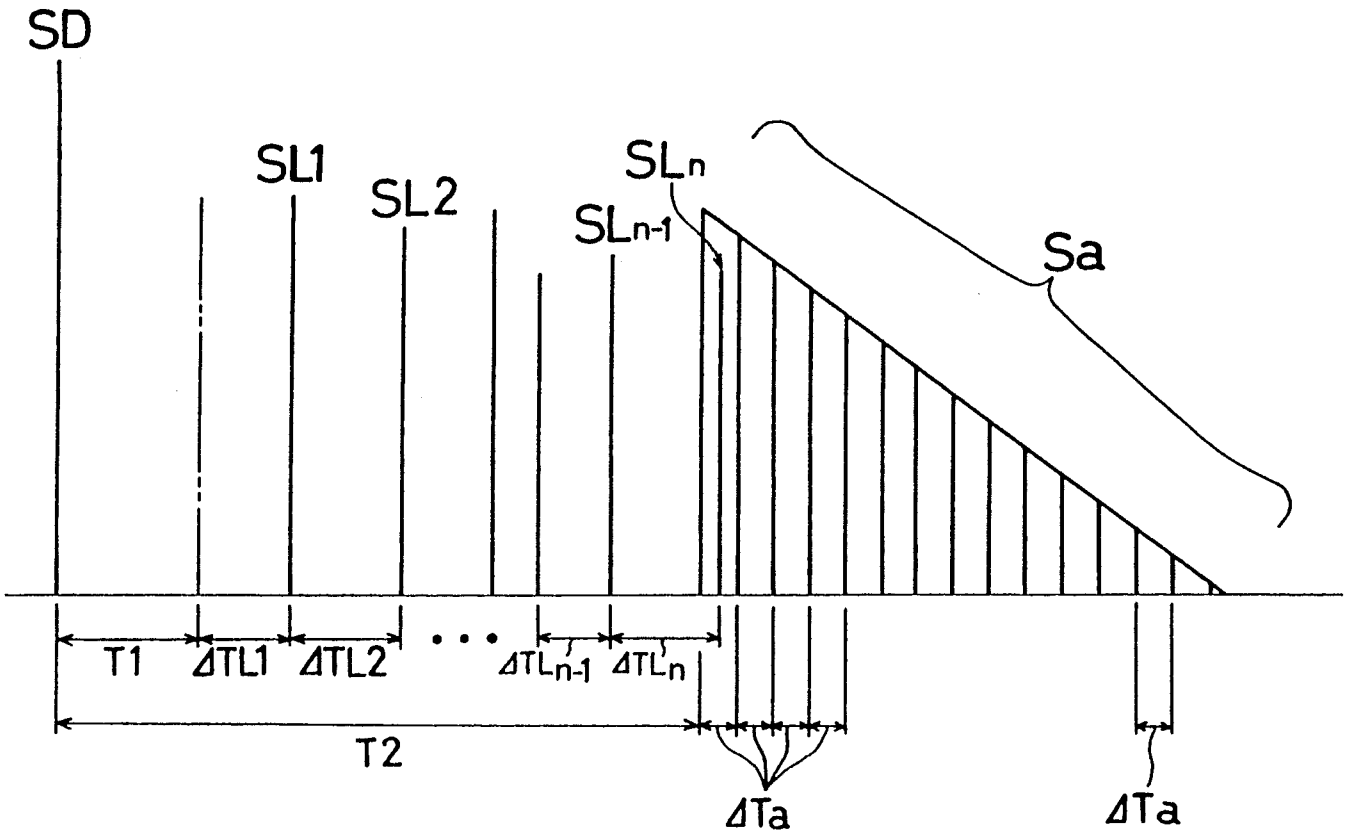
FIG. 8 is a graph showing acoustic spectra of fundamental sounds and effective sounds.

Therefore, when only the left channel is considered, as FIG. 8 shows, from the fundamental sound indicated by reference character SD is formed a first reflecting sound designated by reference character SL1 after time T1+ΔTL1 and, again after time ΔTL2, ΔTL3, . . . , ΔTLn early reflection sounds SL2, SL3, . . . , SLn are respectively formed in succession. The level of each reflection sounds SL1 to SLn are determined by the above noted factors qL1 to qLn. The respective reflective sounds SL1 to SLn correspond to a plurality of reflection paths of sounds reflected from surfaces, such as ceiling, walls, and floor, which define an acoustic space.

Beginning from time T2 after the fundamental sound is released, there will be formed a reverberation sound Sa which attenuates by factor qa for each time ΔTa. Similarly, for the right channel, there will be formed an early reflection sound for each time ΔTR1 to ΔTRn and a reverberation sound Sa which is time ΔTb behind the left channel.

The time T1 and T2; ΔTL1 to ΔTLn; ΔTR1 to ΔTRn; ΔTa and ΔTb, and factors qL1 to qLn; qR1 to qRn; qa are set by the controller 18 in response to the relevant input from the input unit 17, as is the case with the above mentioned phase correction amount θR and attenuation factors aL and aR. By changing such constants for digital signal processing it is possible to simulate acoustic characteristics of a concert hall or football stadium.

Figure 9:
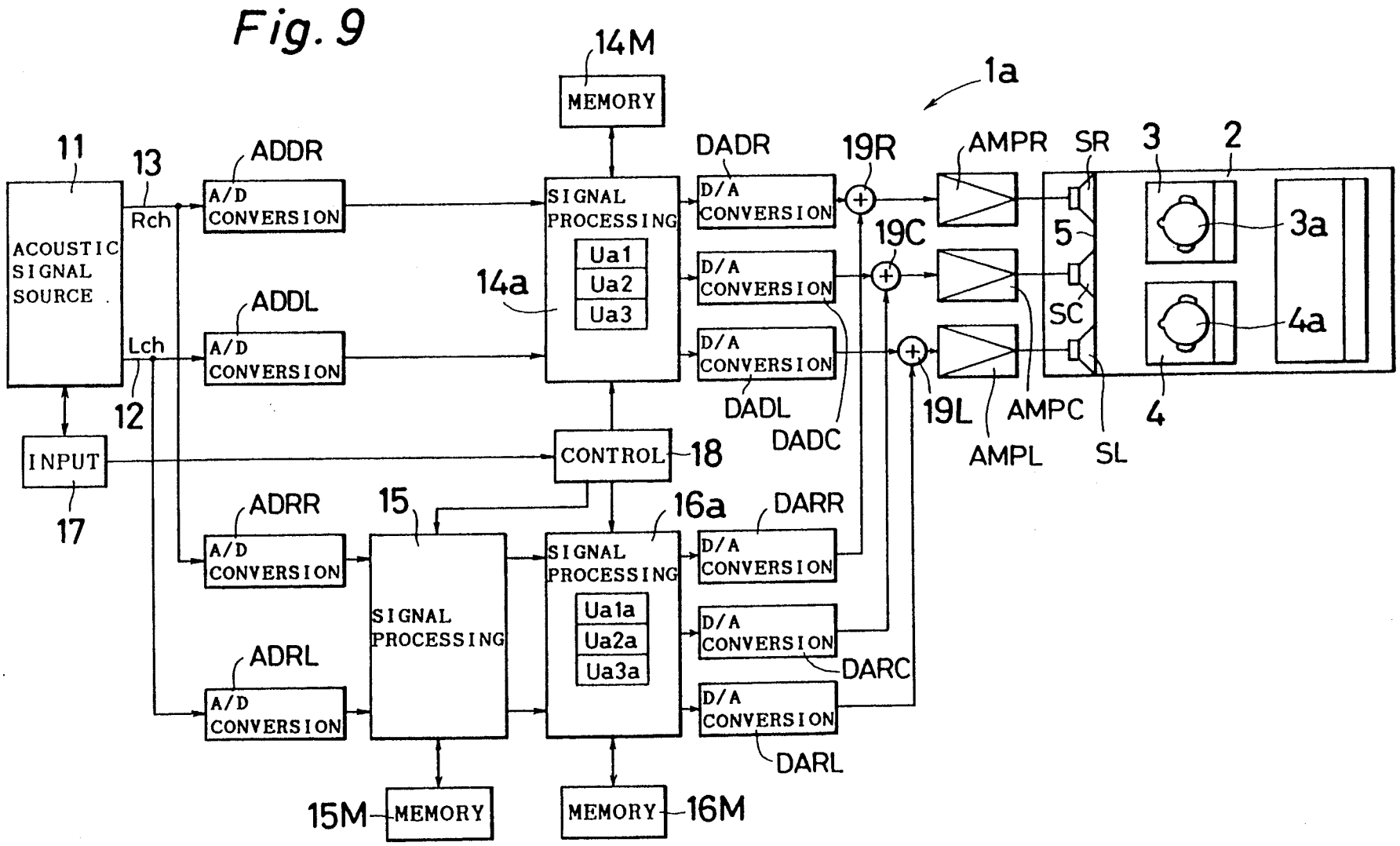
FIG. 9 is a block diagram of an automotive sound reproducing apparatus 1*a* representing another embodiment of the present invention.

FIG. 9 is a block diagram of an automotive sound reproducing apparatus 1*a* representing another embodiment of the present invention. This embodiment is similar to the previous embodiment; units corresponding to those of the previous embodiment are designated by like reference characters. In this embodiment, a center loudspeaker SC is provided, in conjunction with the loudspeakers SL and SR, on the instrument panel 5, the loudspeakers SL and SR being equally spaced from the center loudspeaker SC.

Therefore, left, right-, and center-channel acoustic signals are outputted from signal processing units 14*a* and 16*a*. The center-channel acoustic signals from the signal processing units 14*a* and 16*a* are converted into analog signals respectively by digital analog converters DADC and DARC, which are then added together by an adder unit 19C, the sum of which is supplied through a power amplifier unit AMPC to the center loudspeaker SC.

Figure 10:
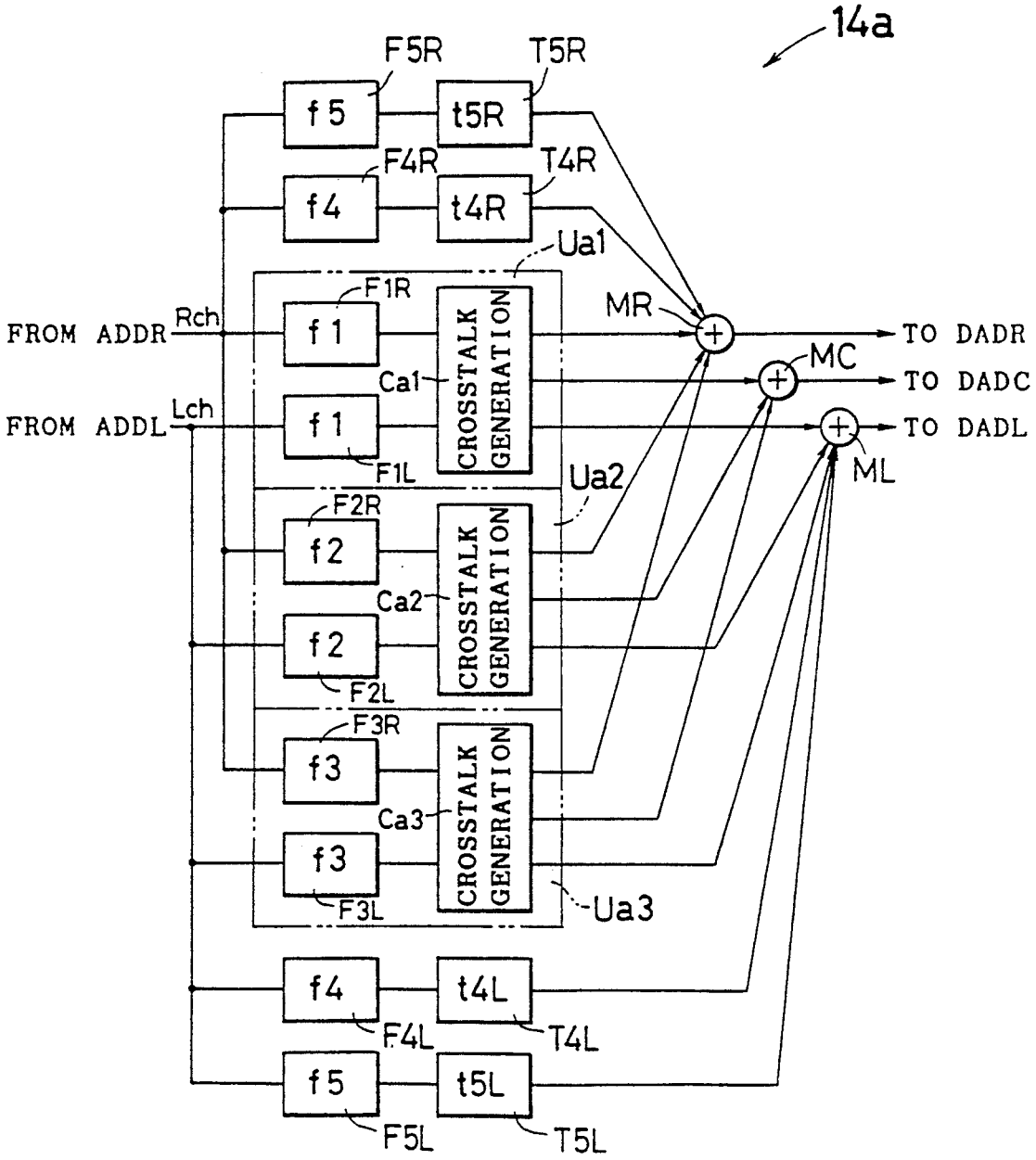
FIG. 10 is a functional block diagram showing a signal processing unit 14*a* employed in the sound reproducing apparatus 1*a;*

In the signal processing unit 14*a*, as FIG. 10 shows, center-channel output, in addition to left- and right-channel outputs, is fed from crosstalk generating units Ca1 to Ca3 in sound image control units Ua1 to Ua3. The center-channel outputs, after being subjected to adding operation at adder unit MC, is outputted to the digital/analog converter DADC.

Figure 11:
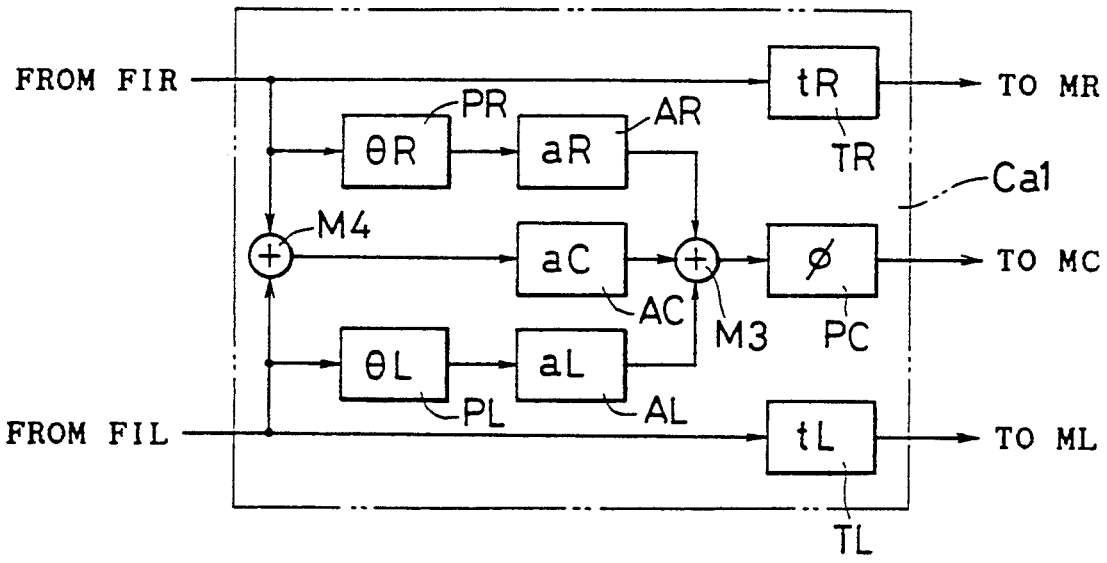
FIG. 11 is a functional block diagram used for an explanation in detail of a crosstalk generating unit Ca1.

Therefore, as FIG. 11 shows, in the crosstalk generating unit Ca1, acoustic signals of fundamental sounds from BPFF1L and F1R are delayed time tL and tR respectively by delay units TL and TR, which are then inputted to the adder units ML and MR. The acoustic signals of fundamental sounds are respectively inputted through the phase units PL and PR and the attenuator units AL and AR to an adder unit M3. The left- and right-channel acoustic signals are added by an adder unit M4 and then multiplied by factor ac by an attenuator unit AC, then inputted to the adder unit M3. An output from the adder unit M3 is corrected in phase by the phase unit PC, which are then outputted as crosstalk signals to the adder unit MC.

The remaining crosstalk generating units Ca2 and Ca3; Ca1*a*, and Ca2*a*, Ca3*a* are of same construction as the crosstalk generating unit Ca1. It is noted, however, that delay time tL and tR of the delay units TL and TR, phase correction amounts θL and θR, the φ of the phase units PL, PR, and PC and the attenuation factors aL, aR, aC are set at different values for respective frequency bands f1, f2, and f3 according to the acoustic characteristics of the vehicle compartment 2, or desired acoustic space characteristics of a concert hall or football stadium.

FIGS. 12(1)–12(4) are plan views used for explaining the functions of sound image control units Ua1 to Ua3. The loudspeaker SR is disposed at a position forming a directional angle θ11 relative to the listener 3a at the driver's seat 3, the center loudspeaker SC at a position forming a directional angle θ12 which is wider than the directional angle θ11, and the loudspeaker SL at a position forming a directional angle θ13 which is wider than the directional angle θ12. Now, when a sound is released from loudspeaker SR only as shown in FIG. 12 (1), the listener 3a perceives the source of sound in a direction shown in reference character l1.

In contrast, when, in conjunction with the right-channel sound from the loudspeaker SR, same sound is released from the center loudspeaker SC, as FIG. 12 (2) shows, the listener 3a perceives the source of sound in a substantially frontward direction indicated by reference character l2.

Therefore, by shifting the phase of acoustic signal by the amount θR by means of the phase unit PR in the crosstalk units Ca1 to Ca3, and further by changing the level by the factor aR by the attenuator unit AR, it is possible to make the listener 3a perceive the source of the right-channel sound in a direction outside the loudspeaker SR as shown by reference character l3 in FIG. 12 (3), instead of the direction l2 in which the sound has been perceived.

However, if, in this state, left-channel sound is released from the loudspeaker SC through phase unit PL, and also left-channel sound from the loudspeaker SL through BPFF1L to F3L, the localization direction of sound image to be localized in the frontward direction of the listener 3a designated by reference character l4 in FIGS. 12 (3) and 13 (1) would shift toward the loudspeaker SR as shown by reference character l5. The reason for this is that although a peak position of energy of the sound designated by reference character l11 in FIG. 13 (2) heard at the listener's position can be set in a frontward direction of the listener 3a designated by reference character l4, the energy distribution will become laterally asymmetrical.

Then, by correcting the phase by the amount φ at the phase unit PC, the energy distribution of sound can be made laterally symmetrical designated by reference character l12 in FIG. 13 (2). Thus, laterally symmetrical sound fields can be formed such that the localization of sound image is localized in the frontward direction of the listener 3a as indicated by reference character l4 in FIGS. 12 (4) and 13 (1) and the range of the sound fields forms an angle of divergence θ3 relative to the frontward direction designated by reference character l6, l7. This angle of divergence θ3 can form ideal sound fields. The amounts θR, φ is adjusted so that an angle of divergence θ3 of, for example, 30 degrees may be obtained.

Figure 14:
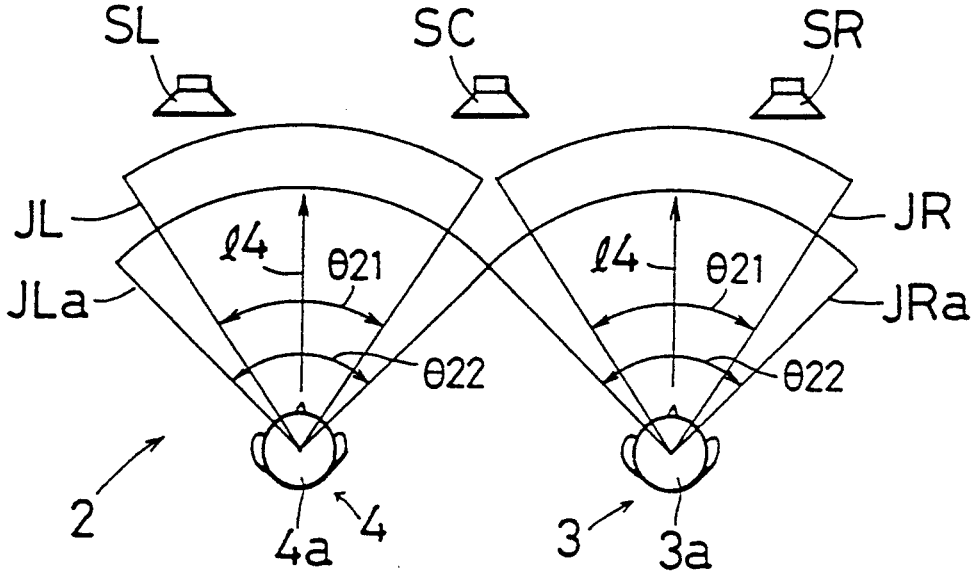
FIG. 14 is a plan view showing a widening effect of sound fields JL and LR of fundamental sounds and sound fields JLa and LRa of effective sounds according to the present invention.

Likewise, for listener 4a at the assistant's seat 4, laterally symmetrical sound fields can be formed by adjusting the amount θL and by the phase units PL and PC. For effective sounds, it is also possible to form laterally symmetrical sound fields by adjusting phase correction amount θLa and θRa, φa by the crosstalk generating units Ca1a to Ca3a in the sound image control units Ua1a to Ua3a, and the attenuation factors aLa, aRa, and aCa. In the case of effective sounds, as shown in FIG. 14, above mentioned amounts θLa, θRa, and φa and attenuation factors aLa, aRa, and aCa are adjusted so that an angle of divergence θ22 may be obtained which is wider than the angle of divergence θ21.

In this way, according to this embodiment, it is possible to form laterally symmetrical sound fields JR and JL at the driver's seat 3 and the assistant's seat 4, whereby sound image can be localized in the frontward direction of the listeners 3a and 3b, without deviation. Sound fields JRa and JLa for effective sounds are formed wider than sound fields JR and JL for fundamental sounds. Thus, in the vehicle compartment 2 which is subject to limitations as to mounting positions for the loudspeakers SL and SR, it is possible to localize sound image in the frontward direction of the listener 3a and 4a and form wider sound fields by separately controlling sound fields JR and JL for fundamental sounds and sound fields JRa and JLa for effective sounds.

It is not that acoustic signals for fundamental sounds and effective sounds may be added together in terms of digital signals then converted into analog signals.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning the range of equivalency of the claims are therefore intended to be embraced therein.

What is claimed is:

1. An apparatus for expanding and controlling sound fields comprising:

an acoustic signal source which outputs acoustic signals of fundamental sounds of two channels, right and left;

a means for correcting at least one of the phase and level of acoustic signals of the fundamental sounds of the right and left channels to form outputs of right, left and center channels;

a means for arithmetically processing the acoustic signals of fundamental sounds of the right and left channels from the acoustic signal source to produce acoustic signals of effective sounds of the right and left channels; and a means for correcting at least one of the phase and level of acoustic signals of effective sounds of the right and left channels to form outputs of right, left and center channels; and wherein outputs of respective channels from the fundamental sounds correcting means and corresponding outputs of respective channels from the effective sounds correcting means are added together for each of the right, left and center channels, which are, in turn, outputted from a loudspeaker for each channel.

2. An apparatus for expanding and controlling sound fields as claimed in claim 1, wherein the right-, left-, and center-channel loudspeakers are such that the center channel loudspeaker is disposed at an angle greater relative to the frontward direction of a listening position than one of the right- and left-channel loud speakers, but smaller than the other.

3. An apparatus for expanding and controlling sound fields as claimed in claim 2, wherein a filter for filtering a predetermined frequency band only is interposed in an early stage of each of the fundamental sounds correcting means and effective sounds correcting means.

4. An apparatus for expanding and controlling sound fields as claimed in claim 2, wherein the fundamental sounds correcting means and the effective sounds correcting means, each comprises:

delay units which delay acoustic signals of respective fundamental sounds or effective sounds, as the case may be, of the right and left channels and outputs same to the corresponding right- and left-channel loudspeakers, means for carrying out phase correction and level correction with respect to acoustic signals of fundamental sounds or effective sounds of right and left channels, means for adding acoustic signals of fundamental sounds or effective sounds of the right and left channels to correct levels, and means for adding acoustic signals from the right and left phase and level correcting means and acoustic signals from the adding means to thereby perform phase correction, and output the phase corrected acoustic signals to the center channel loudspeaker.

5. An apparatus for expanding and controlling sound fields as claimed in claim 4, wherein a filter for filtering a predetermined frequency band only is interposed in an early stage of each of the fundamental sounds correcting means and effective sounds correcting means.

6. An apparatus for expanding and controlling sound field as claimed in claim 1, wherein the fundamental sounds correcting means and the effective sounds correcting means correct at least one of the phase and the level of acoustic signals of the effective sounds and the fundamental sounds so that an angle of divergence of the effective sound is broader that an angle of divergence of the fundamental sound.

7. An apparatus for expanding and controlling sound fields as claimed in claim 5, wherein the fundamental sounds correcting means and the effective sounds correcting means, each comprises:

delay units which delay acoustic signals of respective fundamental sounds or effective sounds, as the case may be, of the right and left channels and outputs same to the corresponding right- and left-channel loudspeakers, a means for carrying out phase correction and level correction with respect to acoustic signals of the fundamental sounds or effective sounds of the right and left channels; and a means for adding the acoustic signals of fundamental sounds or effective sounds of the right and left channels to correct levels;

a means for adding right and left acoustic signals from the phase and level correction means and acoustic signals from the adding means to thereby perform phase correction, and output the resultant phase corrected acoustic signal to the center channel loudspeaker.

8. An apparatus for expanding and controlling sound fields as claimed in claim 7, wherein a filter for filtering a predetermined frequency band only is interposed in an early stage of each of the fundamental sounds correcting means and effective sounds correcting means.

9. An apparatus for expanding and controlling sound field as claimed in claim 1, further comprising: a control means for supplying data relating to at least one of the phase correction amount and the level correction amount to the fundamental sounds correcting means and the effective sounds correcting means wherein, a control band is divided into plural parts; and a crosstalk generating unit provided with each of the plural parts of the control band, wherein the phase correction amount and the level correction amount in the crosstalk generating unit are individually set at each of the plural parts of the control band.

10. An apparatus for expanding and controlling sound fields as claimed in claim 1, wherein a filter for filtering a predetermined frequency band only is interposed in an early stage of each of the fundamental sounds correcting means and effective sounds correcting means.

11. An apparatus for expanding and controlling sound fields comprising:

an acoustic signal source which outputs acoustic signals of fundamental sounds;

a means for correcting at least one of the phase and level of acoustic signals of fundamental sounds from the acoustic signal source to form outputs for a plurality of channels;

a means for arithmetically processing acoustic signals of fundamental sounds from the acoustic signal source to produce acoustic signals of effective sounds; and a means for correcting at least one of the phase and level of the acoustic signals of effective sounds to form outputs for a plurality of channels;

wherein outputs of the plurality of channels from the fundamental sounds correcting means and corresponding outputs of the respective channels from the effective sounds correcting means are added together and are, in turn, outputted from a common loudspeaker for each channel;

and wherein the fundamental sound correcting means and the effective sound correcting means correct at least one of the phase and the level of acoustic signals of the effective sounds and the fundamental sounds so that an angle of divergence of the effective sounds is broader than an angle of divergence of the fundamental sounds.

12. An apparatus for expanding and controlling sound fields comprising:

an acoustic signal source which outputs acoustic signals of fundamental sounds;

a means for correcting at least one of the phase and level of acoustic signals of fundamental sounds from the acoustic signal source to form outputs for a plurality of channels;

a means for arithmetically processing acoustic signals of fundamental sounds from the acoustic signal source to produce acoustic signals of effective sounds, a means for correcting at least one of the phase and level of the acoustic signals of effective sounds to form outputs for a plurality of channels; and a control means for supplying data relating to at least one of the phase correction amount and the level correction amount to the fundamental sounds correcting means and the effective sounds correcting means;

wherein outputs of the plurality of channels from the fundamental sounds correcting means and corresponding outputs of the respective channels from the effective sounds correcting means are added together and are, in turn, outputted from a common loudspeaker for each channel;

and wherein a control band of the fundamental sounds correcting mans and the effective sounds correcting means are respectively divided into plural parts, a crosswalk generating unit being provided with each of the control bands;

and further wherein the phase correction amount and level correction amount are individually set at each of the plural parts of the control band.

13. An apparatus for expanding and controlling sound fields comprising:

an acoustic signal source which outputs acoustic signals of fundamental sounds of two channels, right and left;

a means for correcting at least one of the phase and level of the acoustic signals of fundamental sounds of the right and left channels and outputting same;

a means for arithmetically processing acoustic signals of fundamental sounds of the right and left channels from the acoustic signal source to produce acoustic signals of effective sounds of the right and left channels; and a means for correcting at least one of the phase and level of acoustic signals of effective sounds of the right and left channels and outputting same;

wherein outputs of the right and left channels from the fundamental sounds correcting means and corresponding outputs of the right and left channels from the effective sounds correcting means are added together for each of the right and left channels, and are, in turn, outputted from a loudspeaker for each of the right and left channels;

and wherein the fundamental sound correcting means and the effective sound correcting means correct at least one of the phase and the level of acoustic signals of the effective sounds and the fundamental sounds so that an angle of divergence of the effective sounds is broader than an angle of divergence of the fundamental sounds.

14. An apparatus for expanding and controlling sound fields as claimed in claim 13, wherein the left channel loudspeaker and the right channel loudspeaker are disposed at angularly different positions relative to the frontward direction of a listening position.

15. An apparatus for expanding and controlling sound fields as claimed in claim 14, wherein the fundamental sounds correcting means and the effective sounds correcting means each comprises:

delay units which delay acoustic signals of respective fundamental sounds or effective sounds, as the case may be, of right and left channels and outputs same to the loudspeakers of right and left channels; and a means for carrying out phase correction and level correction with respect to acoustic signals of respective fundamental sounds or effective sounds, as the case may be, of right and left channels and outputs same to the loudspeaker of left and right channels.

16. An apparatus for expanding and controlling sound fields comprising:

an acoustic signal source which outputs acoustic signals of fundamental sounds of two channels, right and left;

a means for correcting at least one of the phase and level of the acoustic signals of fundamental sounds of the right and left channels and outputting same;

a means for arithmetically processing acoustic signals of fundamental sounds of the right and left channels from the acoustic signal source to produce acoustic signals of effective sounds of the right and left channels;

a means for correcting at least one of the phase and level of acoustic signals of effective sounds of the right and left channels and outputting same; and a control means for supplying data relating to at least one of the phase correction amount and the level correction amount to the fundamental sounds correcting means and the effective sounds correcting means;

wherein outputs of the right and left channels from the fundamental sounds correcting means and corresponding outputs of the right and left channels from the effective sounds correcting means are added together for each of the right and left channels, and are, in turn, outputted from a loudspeaker for each of the right and left channels;

and wherein a control band of the fundamental sounds correcting mans and the effective sounds correcting means are respectively divided into plural parts, a crosstalk generating unit being provided with each of the control bands;

and further wherein the phase correction amount and level correction amount are individually set at each of the plural parts of the control band.

17. An apparatus for expanding and controlling sound fields as claimed in claim 16, wherein the left channel loudspeaker and the right channel loudspeaker are disposed at angularly different positions relative to the frontward direction of a listening position.

18. An apparatus for expanding and controlling sound fields as claimed in claim 17, wherein the fundamental sounds correcting means and the effective sounds correcting means each comprises:

delay units which delay acoustic signals of respective fundamental sounds or effective sounds, as the case may be, of right and left channels and outputs same to the loudspeakers of right and left channels; and a means for carrying out phase correction and level correction with respect to acoustic signals of respective fundamental sounds or effective sounds, as the case may be, of right and left channels and outputs same to the loudspeakers of left and right channels.

* * * * *